US006756347B1

(12) United States Patent
Besse et al.

(10) Patent No.: US 6,756,347 B1
(45) Date of Patent: Jun. 29, 2004

(54) ANTIMICROBIAL, BEVERAGE COMPATIBLE CONVEYOR LUBRICANT

(75) Inventors: Michael E. Besse, Golden Valley, MN (US); Joy G. Herdt, New Port, MN (US); Kimberly L. Person Hei, Baldwin, WI (US)

(73) Assignee: Ecolab Inc., St. Paul, MN (US)

( * ) Notice: Subject to any disclaimer, the term of this patent is extended or adjusted under 35 U.S.C. 154(b) by 117 days.

(21) Appl. No.: 09/227,593

(22) Filed: Jan. 8, 1999

Related U.S. Application Data

(63) Continuation-in-part of application No. 09/002,976, filed on Jan. 8, 1999, now abandoned.

(51) Int. Cl.[7] ..... C10M 137/04
(52) U.S. Cl. ..... 508/438
(58) Field of Search ..... 508/438, 441, 508/442

(56) References Cited

U.S. PATENT DOCUMENTS

| | | | | |
|---|---|---|---|---|
| 2,759,975 | A | 8/1956 | Chiddix et al. | 260/567.6 |
| 2,779,740 | A | 1/1957 | Messina et al. | 252/51.5 |
| 3,336,225 | A | 8/1967 | Sayad et al. | 252/374.7 |
| 3,382,032 | A | 5/1968 | Cox | 21/60.5 |

(List continued on next page.)

FOREIGN PATENT DOCUMENTS

| | | | |
|---|---|---|---|
| EP | 0384282 | 2/1990 | C10M/105/60 |
| EP | 0445525 | 9/1991 | C07C/209/00 |
| FR | 0533552 | 3/1993 | C10M/133/08 |
| JP | 2-55794 | 2/1990 | C10M/173/02 |
| JP | 2097592 | 2/1992 | C10M/105/00 |
| JP | 2097593 | 2/1992 | C10M/105/00 |
| JP | 07 34079 | 2/1995 | C10M/105/00 |
| JP | 08333592 | 12/1996 | C10M/105/00 |
| WO | WO96/02616 | 2/1996 | |
| WO | 96/02616 | 2/1996 | C10M/173/02 |

OTHER PUBLICATIONS

Anvy, Y., et al., "Chemical Modification of Polyester Fiber Surfaces by Animation Reactions with Multifunctional Amines", *J. Appl. Polymer Sci.,* vol. 32, 4009–4025, (1986).
"Anionics GAFAC Surfactants", *Rhone–Poulenc Catalog of Surfactants & Specialties,* 5–7, (1993).
"Carbonated Beverages", *Encyclopedia of Chemical Technology, 5,* 4th Edition, John Wiley & Sons Pub., 26–27.
"EMPHOS Organic Phosphate Esters", *Witco Chemical: Organics Division, Bulletin 234,* Witco Chemical: Organics Division, 1,2,4,6,8, (Nov. 1977).

*Primary Examiner*—Cephia D. Toomer
(74) *Attorney, Agent, or Firm*—Merchant & Gould P.C.

(57) ABSTRACT

Lubricating solutions are used on conveying systems in the beverage industry during the filling of containers with beverages. Lubricating compositions of the present invention, especially those designed for use in beverage conveying systems for contained beverages, comprise at least the following components:

a) an alkyl alkoxylated (e.g., ethoxylated or propoxylated, preferably ethoxylated) phosphate ester, b) aryl (e.g., aromatic, such as phenol) alkoxylated (e.g., ethoxylated or propoxylated) phosphate ester, c) an aromatic or linear quaternary ammonium antimicrobial agent, and d) a liquid carrier, such as water.

These lubricating solutions are capable of providing good lubricity and antimicrobial activity over a prolonged time.

76 Claims, 4 Drawing Sheets

U.S. PATENT DOCUMENTS

| | | | | |
|---|---|---|---|---|
| 3,583,914 | A | 6/1971 | Garvin et al. | 252/34.7 |
| 3,645,897 | A | 2/1972 | Gower et al. | 252/34.7 |
| 3,661,784 | A | 5/1972 | Bellos | 252/49.3 |
| 3,672,977 | A | 6/1972 | Dardenfas | 117/138.8 |
| 3,718,588 | A | 2/1973 | Bellos et al. | 252/32.5 |
| 3,860,521 | A | 1/1975 | Aepli et al. | 252/34.7 |
| 3,950,258 | A | 4/1976 | Imai et al. | 252/33 |
| 4,289,636 | A | 9/1981 | Davis et al. | 252/49.3 |
| RE30,885 | E | 3/1982 | Rieder | 252/34 |
| 4,384,965 | A | 5/1983 | Hellsten et al. | 252/32.5 |
| 4,419,253 | A | 12/1983 | Kennedy et al. | 252/34.7 |
| 4,425,248 | A | 1/1984 | Piotrowski et al. | 252/49.3 |
| 4,521,321 | A | 6/1985 | Anderson et al. | 252/49.3 |
| 4,547,303 | A | 10/1985 | Deck et al. | 252/73 |
| 4,557,848 | A | 12/1985 | Sung et al. | 252/51.5 R |
| 4,604,220 | A | 8/1986 | Stanton | 252/33.4 |
| 4,636,321 | A | 1/1987 | Kipp et al. | 508/431 |
| 4,664,834 | A | 5/1987 | Forsberg | 252/77 |
| 4,719,084 | A | 1/1988 | Schmid et al. | 422/16 |
| 4,758,359 | A | 7/1988 | Kirk et al. | 508/174 |
| 4,839,067 | A | 6/1989 | Jansen | 252/11 |
| RE33,032 | E | 8/1989 | Binsack et al. | 524/165 |
| 4,929,375 | A | 5/1990 | Rossio et al. | 252/49.3 |
| 5,009,801 | A | 4/1991 | Wider et al. | 252/33.2 |
| 5,062,979 | A | 11/1991 | Scharf et al. | 252/49.3 |
| 5,073,280 | A | 12/1991 | Rossio et al. | 252/49.3 |
| 5,182,035 | A | 1/1993 | Schmidt et al. | 252/34 |
| 5,190,679 | A | 3/1993 | McDonald | 252/41 |
| 5,223,162 | A | 6/1993 | Rossio | 252/33.2 |
| 5,244,589 | A | 9/1993 | Liu et al. | 252/34 |
| 5,282,992 | A | 2/1994 | Reichgott | 252/51.5 R |
| 5,352,376 | A | 10/1994 | Gutzmann | 252/49.3 |
| 5,391,308 | A | 2/1995 | Despo | 252/32.5 |
| 5,407,700 | A | 4/1995 | Man et al. | 427/154 |
| 5,409,713 | A | 4/1995 | Lokkesmoe et al. | 424/616 |
| 5,419,908 | A | 5/1995 | Richter et al. | 424/405 |
| 5,436,008 | A | 7/1995 | Richter et al. | 424/405 |
| 5,437,868 | A | 8/1995 | Oakes et al. | 424/405 |
| 5,441,654 | A | 8/1995 | Rossio | 252/49.3 |
| 5,462,681 | A | 10/1995 | Gutzmann et al. | 252/11 |
| 5,489,434 | A | 2/1996 | Oakes et al. | 424/405 |
| 5,510,045 | A | 4/1996 | Remus | 252/49.3 |
| 5,667,349 | A | 9/1997 | Turchin et al. | 508/174 |
| 5,723,418 | A * | 3/1998 | Person Hei et al. | 508/511 |
| 6,525,005 | B1 * | 2/2003 | Kravitz et al. | 508/438 |

* cited by examiner

ANTIMICROBIAL, BEVERAGE COMPATIBLE CONVEYOR LUBRICANT

CROSS REFERENCED TO RELATED APPLICATION

This is a continuation-in-part of U.S. patent application Ser. No. 09/002,976 filed Jan. 8, 1999, now abandoned.

BACKGROUND OF THE INVENTION

1. Field of the Invention

The present invention relates to lubricants, especially antimicrobial lubricants, and most especially to antimicrobial lubricants for use in conveyor systems for beverage containers. The lubricants are compatible with beverages and may display reduced deposition of solid materials after the lubricants have contacted spilled beverage.

2. Background of the Art

In the commercial distribution of most beverages, the beverages are packaged in containers of varying sizes, such containers being in the form of cartons, cans, bottles, tetra-pack packages, waxed carton packs, and other forms of containers. In most packaging operations, the containers are moved along conveying systems, usually in an upright position (with the opening of the container facing vertically up or down), and moved from station to station, where various operations are performed (e.g., filling, capping, labeling, sealing, etc.). The containers, in addition to their many possible formats and constructions, may comprise many different types of materials, such as metals, glasses, ceramics, papers, treated papers, waxed papers, composites, layered structures, and polymeric materials (e.g., especially polyolefins such as polyethylene, polypropylene, polystyrene and blends thereof, polyesters such as polyethylene-terephthalate and polyethylenenaphthalate and blends thereof, polyamnides, polycarbonates, etc.).

There are a number of different requirements which are essential or desirable for antimicrobial lubricants in the conveying systems used to carry containers for beverages. The essential requirements are that the material provide an acceptable level of lubricity for the system and that the lubricant displays an acceptable antimicrobial activity. It is also desirable that the lubricant have a viscosity which allows it to be applied by conventional pumping and/or application apparatus (e.g., spraying, roller coating, wet bed coating, etc.) as commonly used in the beverage conveyor lubricating art, and that the lubricant is beverage compatible so that it does not form solid deposits when it accidentally contacts spilled beverage on the conveyor system. This last requirement can be especially important since the formation of deposits on the conveyor will change the lubricity of the system and could require shut-down of the equipment to facilitate cleaning. Deposits may occur from the combination of beverage and lubricant in a number of different chemical methods, depending upon the particular beverage and lubricant used. One of the more common forms of deposit is caused by the formation of micelles from the interaction of species, especially different ionic species within the two materials.

Different types of lubricants have been used in the beverage conveying industry with varying degrees of success. A more common type of lubricant is the fatty acid lubricant (either the acid itself or amine salt and/or ester derivatives thereof), some of which are described in U.S. Pat. No. 5,391,308. Another type of lubricant used within this field is the organic phosphate ester, as shown in U.S. Pat. No. 4,521,321 and PCT Application WO 96/02616, based upon British Patent Application 94/14442.5 filed 18 Jul. 1994 (PCT/GB95/01641).

U.S. Pat. No. 5,391,308 discloses phosphate esters other than alkyl or linear esters (e.g., the alkyl aryl phosphate esters described on column 6, lines 11–20 used in combination with the alkyl or linear phosphate esters). The lubricant system of this patent also requires the use of an aqueous based long chain fatty acid composition at a pH of from 9.0 to 10.5 as the lubricant, with specifically combined ingredients to avoid stress cracking in polyethylene terephthalate (PET) bottles transported on a conveyor system. The aromatic-polyoxyalkyl esters are specifically disclosed as part of a combination of esters (along with the alkyl esters) which > "... results in substantial reduction in stress cracking, thus functioning as the stress cracking inhibiting agent, as well as the emulsifying agent, in the aqueous lubricant concentrate.@ (Column 3, lines 48–52)."

The reference is specific to fatty acid lubricants, and the specification points out that the use of potassium hydroxide as the saponifying agent, in fatty acid lubricants, has been found to contribute to and to promote stress cracking in P.E.T. (polyethylene terephthalate) bottles. A blend of alkyl phosphate esters and aromatic phosphate esters are shown in combination with the fatty acid lubricant to reduce stress cracking.

PCT Application WO 96/02616 describes the use of lubricant concentrates comprising organic alkyl phosphate esters, aromatic biocidal quaternary ammonium compounds, and sufficient base to provide the concentrate with a pH of from 5 to 10.

U.S. Pat. No. 4,521,321 describes lubricants for conveyor systems which comprise dilute aqueous systems of partially neutralized monophosphate aliphatic (e.g., saturated or partially unsaturated linear alkyl). The use of a synergist such as long chain fatty alcohol, fatty acid derived amine oxide, or urea improves the properties of the lubricant.

U. S. Pat. No. 5,062,979 describes lubricants for conveyor systems comprising aqueous, clear solution-forming, substantially soap-free compositions. These lubricants comprise pH 6–8 compositions comprising alkyl benzene sulfonates, partial phosphate esters with alkoxylated aliphatic alcohols, and aliphatic carboxylic acids. Typical additives such as solubilizers, solvents, foam inhibitors and disinfectants may also be present. The aliphatic carboxylic acids arc C6–C12 fatty acids.

SUMMARY OF THE INVENTION

Lubricating compositions of the invention, especially those designed for use in beverage conveying systems for contained beverages, comprise at least the following components:

a) an alkyl alkoxylated (e.g., ethoxylated or propoxylated, preferably ethoxylated) phosphate ester, b) aryl (e.g., aromatic, such as phenol) alkoxylated (e.g., ethoxylated or propoxylated) phosphate ester, c) an aromatic or linear quaternary ammonium antimicrobial agent, and d) a liquid carrier, such as water.

Particularly desirable optional agents with high degrees of utility include chelating agents (e.g., the aminoacetic acid chelating agents such as ethylrene diamine tetraacetic acid, EDTA), detergents (e.g., nonionic surfactants) and pH control agents, e.g, potassium or sodium hydroxide.

DETAILED DESCRIPTION OF THE INVENTION

Figure 1:
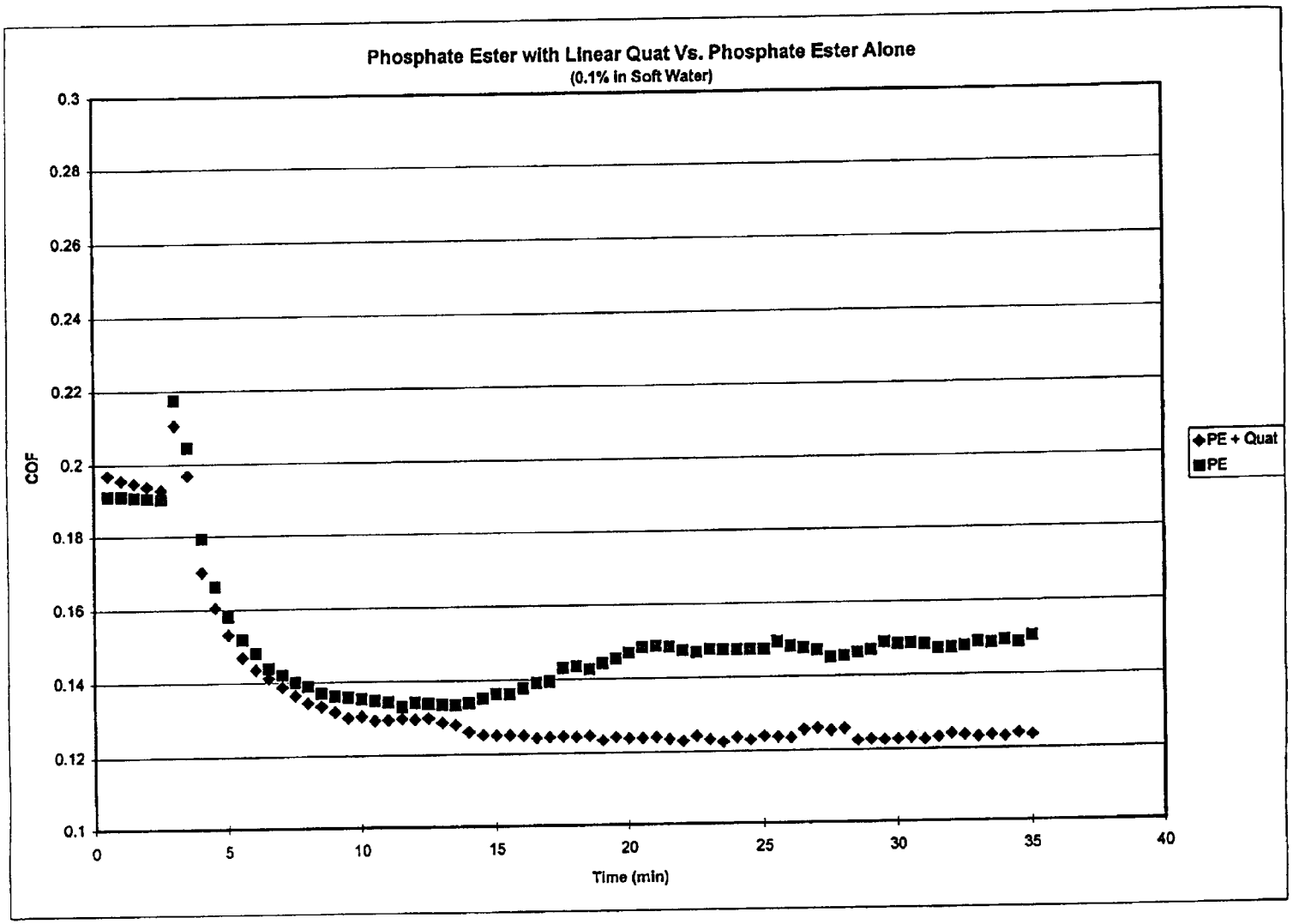
FIG. 1 shows a graph of data relating the Coefficient of Friction (kinetic) for phosphate esters alone, versus phosphate esters mixed with quaternary ammonium biocides.

Lubricant compositions according the present invention comprise at least the following components:

a) an alkyl alkoxylated (e.g., ethoxylated or propoxylated, preferably ethoxylated) phosphate ester, b) phenol alkoxylated (e.g., ethoxylated or propoxylated) phosphate ester, c) an aromatic or linear quaternary ammonium antimicrobial agent, and d) a liquid carrier, such as water.

The lubricating compositions are usually provided as concentrates which are diluted with the appropriate liquid (e.g., usually water) to up to a 400 times dilution to provide a use solution of the lubricant composition. These compositions are capable of providing a number of beneficial properties as lubricant use solutions, and especially as lubricant use solutions for conveying systems for beverage containers. Each of the ingredients and the various types of properties sought for the lubricant compositions are described below. "Lubricant compositions" is a term used to cover both the lubricant concentrate and the lubricant use solution which is formed by dilution of the concentrate with the appropriate thinning liquid, usually water.

An alkyl alkoxylated (e.g., ethoxylated or propoxylated, preferably ethoxylated) phosphate ester has the general structural formula of:

$$R^1—O—([CH_2]m—O)n—PO_3X_2$$

wherein $R^1$ comprises an alkyl group (e.g., linear, branched or cyclic alkyl group of from 1 to 20 carbon atoms, preferably of from 8 to 12 carbon atoms), m is 2 or 3, n is 3 to 8 when m is 3, and 3 to 10 when m is 2, and X is hydrogen, an alkanolamine and/or an alkali metal.

The alkyl groups of $R^1$ may be variously substituted so as to provide a variety of subtle changes in its physical properties, especially with respect to its solubility (e.g., the addition of solubilizing groups or pH adjusting groups) and ionic qualities. Where the phosphate ester comprises an ethoxylated phosphate ester structure, another representative formula would be:

$$R^1—O—([CH_2]_2—O)n—PO_3X_2$$

wherein $R^1$ comprises an alkyl group (e.g., linear, branched or cyclic alkyl group of from 1 to 20 carbon atoms, preferably of from 8 to 12 or 10 to 12 carbon atoms), n is 3 to 8 or 3 to 10, preferably from 4 to 6 with a weight average of about 5, and X is hydrogen, an alkanolamine and/or an alkali metal.

An aromatic (e.g., aryl, phenol, naphthol, etc.) alkoxylated (e.g., ethoxylated or propoxylated) phosphate ester has the general formula of:

$$R^2R^3C_6H_3—O—\{R^4O\}n—PO_3X_2$$

wherein $R^2$ and $R^3$ may be independently selected from the group consisting of hydrogen and alkyl group (e.g., linear, branched or cyclic alkyl group of from 1 to 20 carbon atoms, preferably of from 8 to 12 carbon atoms), $R^4$ is selected from —$CH_2CH_2$—and —$CH_2CH_2CH_2$— (ethylene and propylene), and n and X are as defined above.

Again, alkyl groups of $R^2$ and $R^3$ may be variously substituted so as to provide a variety of subtle changes in its physical properties, especially with respect to its solubility (e.g., the addition of solubilizing groups or pH adjusting groups) and ionic qualities. At the present time, it is preferred that $R^2$ and $R^3$ are hydrogen.

The aromatic and/or linear quaternary ammonium antimicrobial agents are materials generally known in the antimicrobial art. This class of compounds may be generally represented by the formula:

$$R^5R^6R^7R^8N^+X^-$$

wherein $R^5$, $R^6$, $R^7$ and $R^8$ are selected from the group consisting of aryl (e.g., phenyl, furyl, etc.), alkyl arene (e.g., benzyl), and alkyl group. When any one or more of $R^5$, $R^6$, $R^7$ and $R^8$ are aryl or alkyl arene, the compound is referred to in the art as an aromatic quaternary ammonium compound. It is preferred that no more than two of $R^5$, $R^6$, $R^7$ and $R^8$ have more than 4 carbon atoms, with 8 to 18 carbon atoms being preferred for longer chain alkyl groups. It is possible to have all four of $R^5$, $R^6$, $R^7$ and $R^8$ have from 1 to 4 carbons atoms, with 8–18 carbon atoms preferred, and with independent variations in the number of carbon atoms in the groups and distribution of these groups within the compounds being acceptable.

It is preferred that the composition contain a basic compound, e.g., an alkali metal hydroxide or ammonium salt to control the pH. It is preferred that the composition has a pH of less than 8.5, more preferred that it have a pH less than 8.0 and more preferably that it have a pH between 4.5 and 8.0 or 6.0 and 8.0. The control of the pH level within the range of about 6.0 to about 8.5 has been found to provide another unique benefit to the compositions of the present invention. The microbial activity of the compositions tends to increase significantly when the compositions of pH 6.0 to 8.5 have their pH levels reduced, as by contact with acidic beverages (which most commercial beverages and juices are). This increased activity upon exposure to beverages with a pH lower than that of the lubricant preserves the antimicrobial activity until such time as the activity is needed most, when sustenance is provided for the growth of the microbes, e.g., by the spillage of beverages. As the presence of the beverage tends to reduce the pH of the lubricant, the activity of the antimicrobial agent is better preserved and more efficiently used by such activation.

Figure 4:
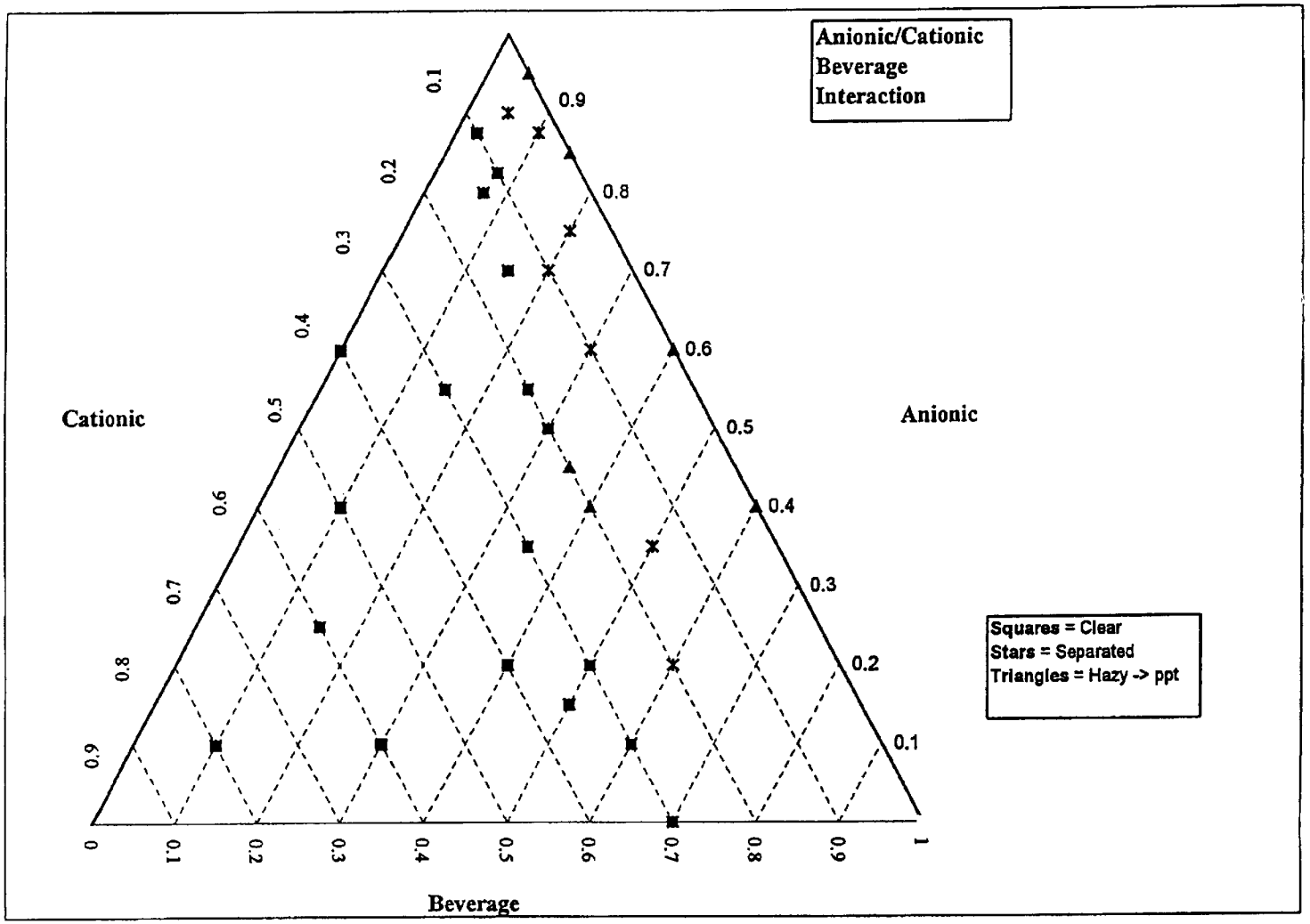
FIG. 4 shows a triangular graph of the effects of variations among anionic surfactants, cationic surfactants and beverage in the practice of the present invention.

Although the lubricant compositions of the present invention are novel with any combination of a) an alkyl alkoxylated (e.g., ethoxylated or propoxylated, preferably ethoxylated) phosphate ester, b) aromatic (e.g., phenol) alkoxylated (e.g., ethoxylated or propoxylated) phosphate ester, c) an aromatic or linear quaternary ammonium antimicrobial agent, (with or without a liquid carrier) there are ranges and proportions of these combinations which provide improved or enhanced performance as compared to the broad range of compositions. For example, the relative proportion of anionic to cationic materials in the lubricant composition (i.e., the relative proportions of the combined total of phosphate ester [anionics] compared to the total of quaternary ammonium microbial agents on a weight to weight basis) affects the degree to which sedimentation, precipitation, cloudiness and deposits occur in the lubricant compositions when contacted with beverages. The higher the proportion of anionics to cationics, the more strongly the compositions resist deposits. It is preferred that the proportion of anionics to cationics is at least 1.5, usually within the range of 2.0 to 10.0, more preferably within the range of 2.0 to 8.0. As noted, the greater the amount of beverage to which the lubricant is likely to be exposed, the higher the preferred ratio of anionics to cationics. The proportions of materials within the concentrate compositions may also be described in terms of 7–30 weight percent anionic materials and 1–5 weight percent cationic materials. These percentages allow for a maximum range of about 30:1 to 1.28:1 ratios by weight of anionic materials to cationic materials. Unless otherwise stated, all proportion described in At the examples are percentages by weight. FIG. 4 shows some of these interactive effects.

The lubricant of the present invention can have the alkyl phosphate ester and aryl phosphate ester present in a weight to weight ratio of 1.5:1 to 10.0:1 with respect to the quaternary ammonium antimicrobial agent. In another embodiment, the lubricant can include a composition with the total weight of the alkyl phosphate ester and the aryl phosphate ester present in a weight to weight ratio of 2.0:1 to 10.0:1 with respect to quaternary ammonium antimicrobial agent. This embodiment can include a linear quaternary ammonium antimicrobial agent. This lubricant can be employed in the process of the invention.

Additional ingredients which do not significantly and adversely affect the stability and lubricating properties of the composition may also be present in the compositions of the invention. Coupling agents, that is materials which have an affinity for both hydrophilic and hydrophobic materials may be included within the compositions. Coupling agents are also referred to as hydrotropes, chemicals which have the property of increasing the aqueous solubility of variously slightly soluble organic compounds. The compounds often have both hydrophilic and hydrophobic fanctionalities within a single molecule to display affinity to both environments, and are commonly used in the formulation of liquid detergents.

Another attribute of the present invention is that the lubricants of the invention tend to have a wider range of utility with respect to the container material and the conveyor material. It has usually been the practice in the art to specifically design lubricant compositions for use with particular container compositions and conveyor support materials. The supporting surfaces on conveyors may comprise fabric, metal, plastic, composite and mixtures of these materials. Lubricants would preferably be compatible with a variety of these surfaces. Similarly, bottle compositions may comprise metals, glasses, papers, treated papers, coated papers, laminates, ceramics, polymers, and composites, and the lubricant compositions would preferably have a range of compatibility with all of these materials. Although there may be some variation in the quality of performance with certain materials, the lubricants of the present invention do tend to display a greater latitude in acceptable performance with a range of materials than many lubricant compositions.

Possible optional agents with high degrees of utility include chelating agents (e.g., EDTA), nonionic detergents, and alkalating agents, e.g, potassium, sodium hydroxide, or alkanolamines. The preferred chelating agents for use in the practice of the present invention are the amine-type acetic acids. These chelating agents typically include all of the poly(amine-type) chelating agents as described in U.S. Pat. No. 4,873,183. Other chelating agents such as nitrilotriacetic acid, alkali metal salts of glucoheptanoate, and organic substituted phosphoric acid, and their equivalents are also useful in the practice of the present invention. The chelating agents arc preferably present as from 0.05 to 10% by weight of the lubricant concentrate composition, preferably from 0.05 to 2% by weight. These chelating agents include chelating agent for divalent cations in said lubricant.

In a synthetic lubricant environment, the invention has found that quaternary ammonium antimicrobial agents, and especially the linear quaternary compounds act as lubricants in combination with the linear and phenol phosphate esters. At least one of the referenced art (e.g., PCT GB95/01641, page 17, lines 12–18) specifically shows that the combination of quaternary ammonium compounds with the alkyl (linear) phosphate esters did not affect lubricity. The finding that the combination of the quaternary ammonium antimicrobial agents with the combination of esters of the present invention actually increases lubricity (reduces the coefficient of friction) provides a basis for the assertion of unexpected results in the defined chemical classes of compounds.

Exemplary Formula

| Raw Material | Chemical Name | (%) |
|---|---|---|
| Soft water | | 65.50 |
| Phosphate Ester | $C_{10-12}$ alkyl phosphate ester, 5 EO units | 12.50 |
| Rhodafac ™ RP-710 | phenol ethoxylated phosphate ester | 2.50 |
| Bardac ™2250 | didecyl dimethyl ammonium chloride, 50% | 5.00 |
| Versene ™100 | EDTA, 40% | 10.00 |
| NaOH, 50% | NaOH | 2.00 |
| Neodol ™25-7 | $C_{12-15}$ linear alcohol, 7 EO | 2.50 |
| | | 100.00 |

EXAMPLE 1

Two formulae were prepared as set out below. The first formula contained the blended phosphate esters, EDTA, NaOH, and linear quaternary ammonium antimicrobial agent. The second formula was identical with the exception of the linear quat.

0.1% use solutions of each formula were prepared in softened water. This solution was sprayed on the short track conveyor which was set up with glass bottles held stationary as the stainless steel conveyor rotated at 100 rpm. The drag was measured with a load cell, which was in turn connected to a computer which plotted the COF (kinetic) based on the drag and the load. The results are presented below in FIG. 1, a graph displaying the coefficient of friction (COF) versus time for a phosphate ester with a linear quat versus a phosphate ester used alone.

Formulas

| Raw Material | Chemical Name | Formula (%) 10-1 | 10-2 |
|---|---|---|---|
| Soft Water | | 68.0 | 73.0 |
| PE | $C_{10-12}$ alkyl phosphate ester, 5 EO units | 12.5 | 12.5 |
| PR-710 | phenol ethoxylated phosphate ester | 2.5 | 2.5 |
| Versene ™100 | EDTA, 40% | 10.0 | 10.0 |
| NaOH | NaOH | 2.0 | 2.0 |
| Bardac ™2250 | didecyl dimethyl ammonium chloride, 50% | 5.0 | 0.0 |
| | | 100.0 | 100.0 |

Conclusions

The inclusion of linear quat in the formula improves the lubricity over a lubricant containing only the blend of phosphate esters.

EXAMPLE 2

Two formulas of lubricating agents were prepared as set out below. The first formula contained the blended phosphate esters, EDTA, NaOH, nonionic surfactant, and linear quaternary ammonium antimicrobial agent. In the second formula, the linear quaternary ammonium antimicrobial agent was replaced with benzyl quat.

Figure 2:
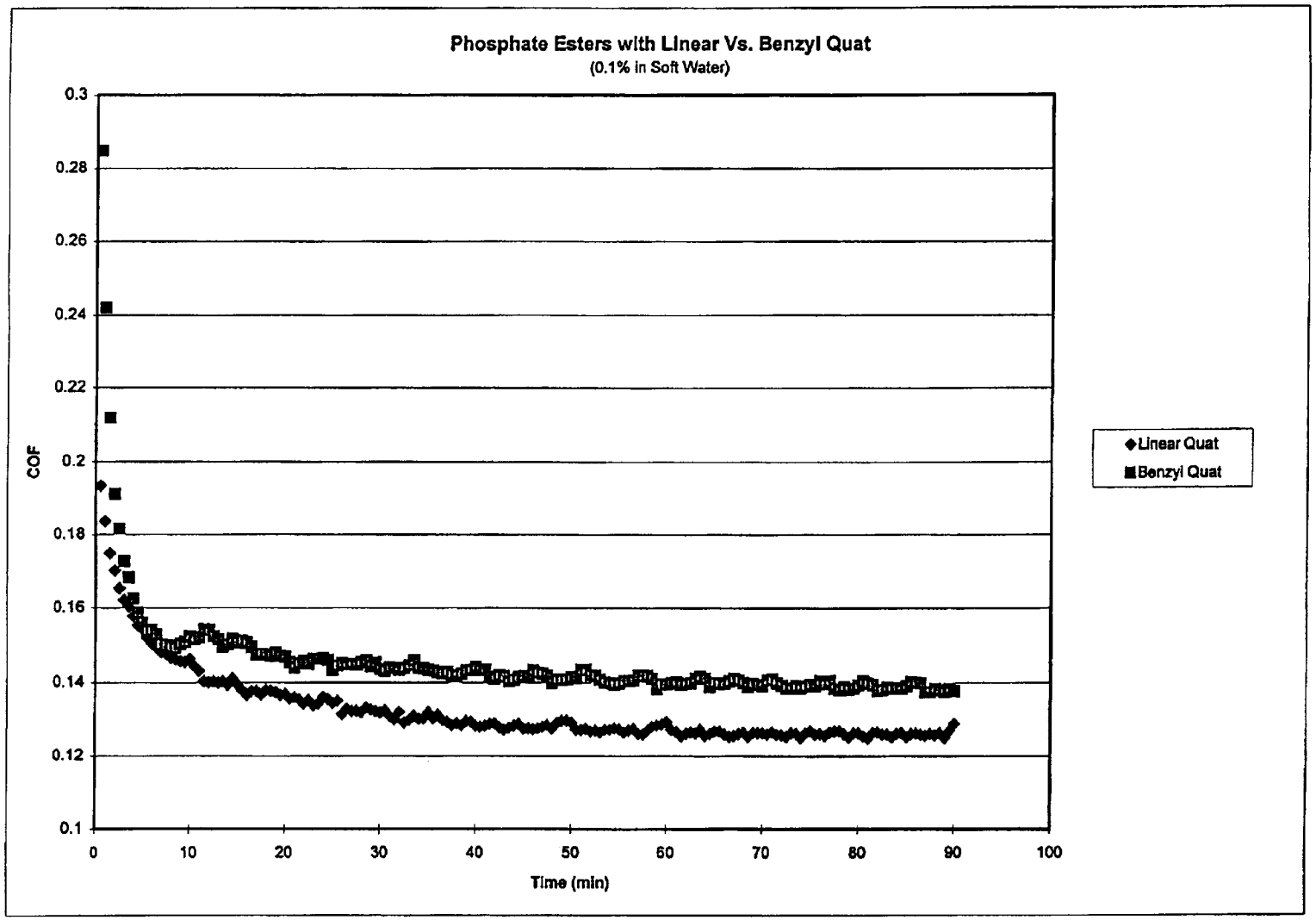
FIG. 2 shows a graph of data relating the Coefficient of Friction (kinetic) of phosphate esters lubricating compositions containing either linear quaternary ammonium biocides or aromatic quaternary ammonium biocides.
Figure 3:
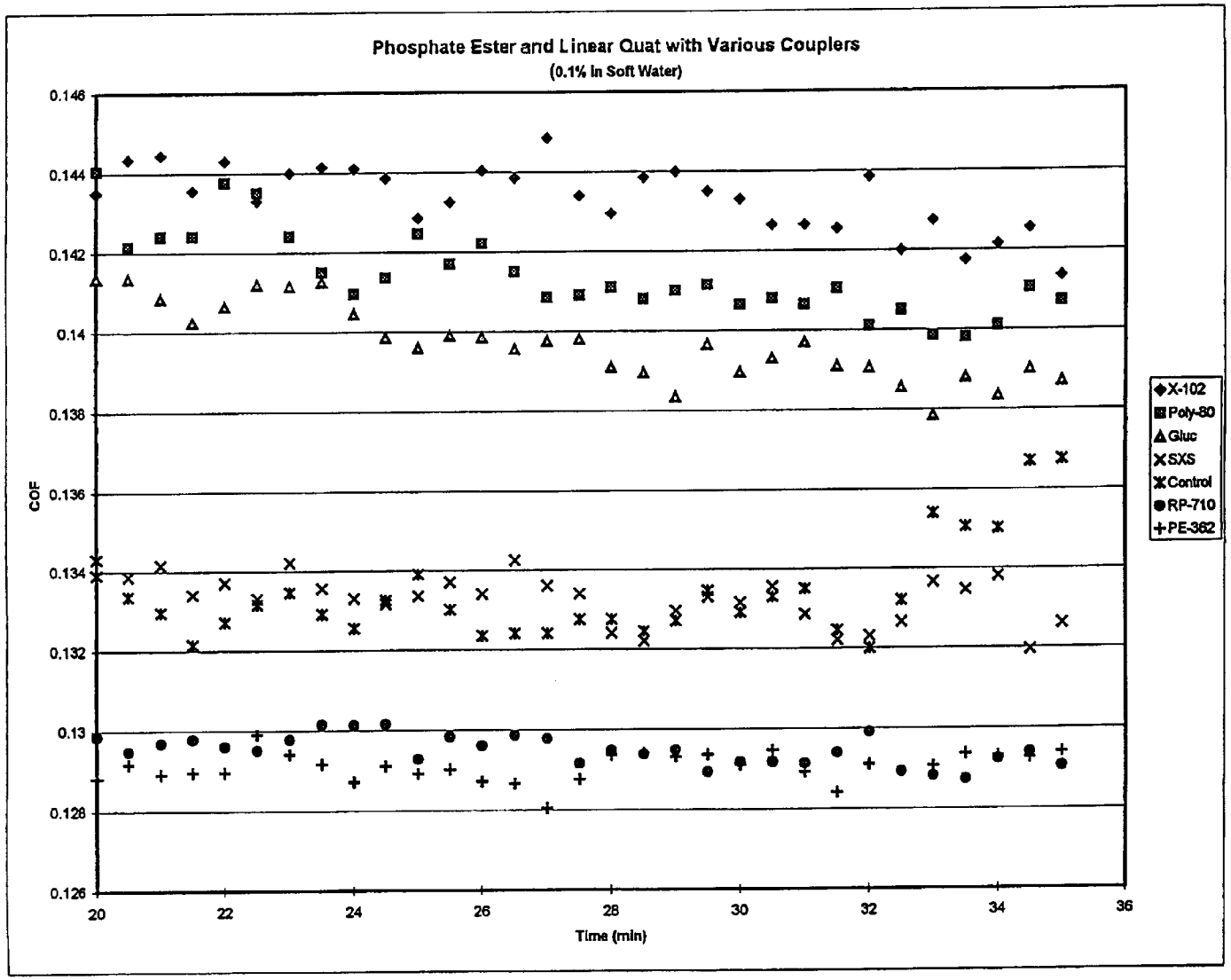
FIG. 3 shows a graph of data relating the Coefficient of Friction (kinetic) for a lubricant composition of the invention as compared to various lubricant compositions with various couplers (e.g., hydrotropes).

0.1% use solutions of each formula were prepared in softened water. This solution was sprayed on the short track conveyor which was set up with glass bottles held stationary as the stainless steel conveyor rotated at 100 rpm. The drag was measured with a load cell, which was in turn connected to a computer which plotted the COF (kinetic) based on the drag and the load. The results are presented in FIG. 2 which shows a comparison of COF versus time for phosphate esters with either a linear quat or a benzyl quat.

Formula

| Raw Material | Chemical Name | Formula (%) KX | 10-3 |
|---|---|---|---|
| Soft Water | | 68.0 | 68.0 |
| PE | $C_{10-12}$ alkyl phosphate ester, 5 EO units | 12.5 | 12.5 |
| PR-710 | Phenol ethoxylated phosphate ester | 2.5 | 2.5 |
| Versene ™100 | EDTA, 40% | 10.0 | 10.0 |
| NaOH | NaOH | 2.0 | 2.0 |
| Bardac ™2250 | didecyl dimethyl ammonium chloride, 50% | 5.0 | 0.0 |
| Q-372 | benzyl quat, 50% (a mixture of alkyldimethyl-benzyl ammonium chlorides) | 0.0 | 5.0 |
| | | 100.0 | 100.0 |

Conclusions

The linear quat species improves the lubricity of the formula as compared to the benzyl quat.

EXAMPLE 3

Two formulae were prepared as set out below. The first formula contained blended alkyl and aryl phosphate esters and the second formula contained only alkyl phosphate ester. Both formulas contained EDTA, nonionic, NaOH, and linear quat.

The viscosity of the concentrates was measured in triplicate on a Brookfield viscometer model RVT at 51, 78 and 116° F. (spindle #3, 100 rpm, factor =10). The results are provided below.

Formula

| Raw Material | Chemical Name | Formula (%) | |
|---|---|---|---|
| Soft Water | | 65.50 | 65.50 |
| PE | $C_{10-12}$ alkyl phosphate ester, 5 EO units | 15.00 | 12.50 |
| Versene ™100 | EDTA, 40% | 10.00 | 10.00 |
| NaOH, 50% | NaOH | 2.00 | 2.00 |
| Bardac ™2250 | didecyl dimethyl ammonium chloride, 50% | 5.00 | 5.00 |
| Neodol ™25-7 | $C_{12-15}$ linear alcohol, 7 EO | 2.50 | 2.50 |
| Rhodafac ™ RP-710 | phenol ethoxylated phosphate ester | | 2.50 |
| | | 100.00 | 100.00 |

Results

| Temperature (° F.) | Phosphate Ester(s) | Average Viscosity (cps) |
|---|---|---|
| 51 | Alkyl and Phenol blend | 50 |
| 78 | Alkyl and Phenol blend | 51 |
| 116 | Alkyl and Phenol blend | 49 |
| 51 | Alkyl | 170 |
| 78 | Alkyl | 132 |
| 116 | Alkyl | 64 |

Conclusions

Blending phenol phosphate ester with alkyl phosphate ester in the formula reduces the viscosity at all temperatures tested and the resultant low viscosity appears to be temperature independent. This property provides for ease of application on a conventional conveyor apparatus.

EXAMPLE 4

Formulas containing alkyl phosphate ester and linear quat were prepared with various nonionic and anionic adjuvants to determine the affect on lubricity. A control containing phenol phosphate ester, a control with higher level of alkyl phosphate ester, and a control with no adjuvant were prepared for comparative purposes. The formulas are provided below.

0.1% use solutions of each formula were prepared in softened water. This solution was sprayed on the short track conveyor which was set up with glass bottles held stationary as the stainless steel conveyor rotated at 100 rpm. The drag was measured with a load cell, which was in turn connected to a computer which plotted the COF based on the drag and the load. Each sample was run two or more times, and the average COF was calculated. The results are provided in Table A below.

TABLE A

| Raw Material | Chemical Name | Formulas 1 | 2 | 3 | 4 | 5 | 6 | 7 |
|---|---|---|---|---|---|---|---|---|
| Soft Water | above | 68.00 | 65.50 | 61.70 | 65.50 | 65.50 | 65.50 | 65.50 |
| PE-362 | above | 12.50 | 15.00 | 12.50 | 12.50 | 12.50 | 12.50 | 12.50 |
| Versene ™ 100 | above | 10.00 | 10.00 | 10.00 | 10.00 | 10.00 | 10.00 | 10.00 |
| NaOH, 50% | above | 2.00 | 2.00 | 2.00 | 2.00 | 2.00 | 2.00 | 2.00 |
| Bardac ™ 2250 | above | 5.00 | 5.00 | 5.00 | 5.00 | 5.00 | 5.00 | 5.00 |
| Neodol ™ 25-7 | above | 2.50 | 2.50 | 2.50 | 2.50 | 2.50 | 2.50 | 2.50 |
| SXS, 40% | Na/xylene Sulfonate | | | 6.30 | | | | |
| Rhodafac ™ RP-710 | above | | | | 2.50 | | | |
| Polysorbate ™ 80 | sorbitan monooleate | | | | | 2.50 | | |
| Glucopan ™ 625CSUP | Alkyl poly glycoside | | | | | | 2.50 | |
| Triton ™ X-102 | octyl phenol ethoxylate | | | | | | | 2.50 |

Conclusions

The phenol and alkyl phosphate esters improved lubricity over the control, while none of the other adjuvants showed this advantage.

EXAMPLE 5

This example examines the ratios of phosphate ester and quat which do not interact with beverage to form a precipitate. A 40% phosphate ester solution in soft water was combined with 10% active linear quat solution in water and a cola beverage at various levels. After one day, the samples were observed for clarity. Samples were rated as clear, hazy, and separated. (Over time, all hazy samples formed precipitates.)

Results

See the ternary plot in FIG. 4.

Conclusions

At higher levels of beverage a higher ratio of anionic to cationic surfactant is required to maintain clarity. The ratio ranges from about 1.5:1 at very low levels of beverage, to 2.5:1 at 50% beverage and 16:1 at very high levels of beverage.

What we claim is:

1. An antimicrobial phosphate ester conveyor lubricant comprising:

alkyl alkoxylated phosphate ester, the total concentration of phosphate ester being 7–30 wt-% of the lubricant;

1–5 wt-% linear quaternary ammonium antimicrobial agent;

chelating agent; and water;

wherein:

the antimicrobial phosphate ester conveyor lubricant is free of fatty acid; and phosphate ester and the liner quaternary ammonium antimicrobial agent are present in a weight ratio of 1.5:1 to about 30:1.

2. The lubricant of claim 1, wherein the ratio of phosphate ester to the quaternary ammonium antimicrobial agent is effective to retain clarity of a mixture of the lubricant and a beverage.

3. The lubricant of claim 1, wherein the pH of the lubricant is less than 8.5.

4. The lubricant of claim 1, wherein the lubricant is formulated to provide increased antimicrobial activity of the linear quaternary ammonium antimicrobial agent when the lubricant is mixed with a beverage having a pH lower than the lubricant.

5. The lubricant of claim 1, further comprising sodium hydroxide.

6. The lubricant of claim 1, wherein the chelating agent comprises an aminoacetic acid chelating agent.

7. The lubricant of claim 1, further comprising alcohol ethoxylate comprising a $C_{12}$–$C_{15}$ linear alcohol with 7 ethylene oxide units.

8. The lubricant of clam 1, further comprising aryl alkoxylated phosphate ester.

9. The lubricant of claim 8, wherein the aryl alkoxylated phosphate ester comprises a phenol phosphate ester wherein the phenol group is not substituted with alkyl groups.

10. The lubricant of claim 8, comprising alkyl alkoxylated phosphate ester comprising an alkyl group of 10 to 12 carbon atoms and an alkoxy moiety of 5 ethylene oxide units, phenol ethoxylated phosphate ester, didecyl dimethyl ammonium chloride, EDTA, and water; and further comprising, alkali metal hydroxide or ammonium salt and $C_{12-15}$ linear alcohol ethoxylated with 7 ethylene oxide units.

11. An antimicrobial phosphate ester conveyor lubricant comprising:

alkyl alkoxylated phosphate ester, and aryl alkoxylated phosphate ester, the total concentration of phosphate ester being 7–30 wt-% of the lubricant;

1–5 wt-% quaternary ammonium antimicrobial agent;

chelating agent; and water;

wherein:

the antimicrobial phosphate ester conveyor lubricant is free of fatty acid; and phosphate ester and the quaternary ammonium antimicrobial agent are present in a weight ratio of 1.5:1 to about 30:1.

12. The lubricant of claim 11, wherein the quaternary ammonium antimicrobial agent comprises a linear quaternary ammonium antimicrobial agent.

13. The lubricant of claim 11, wherein the ratio of phosphate ester to the quaternary ammonium antimicrobial agent is effective to retain clarity of a mixture of the lubricant and a beverage.

14. The lubricant of claim 11, wherein the pH of the lubricant is less 8.5.

15. The lubricant of claim 11, wherein the lubricant is formulated to provide increased antimicrobial activity of the quaternary ammonium antimicrobial agent when the lubricant is mixed with a beverage having a pH lower than the lubricant.

16. An antimicrobial phosphate ester conveyor lubricant comprising:

alkyl alkoxylated phosphate ester, the total concentration of phosphate ester being 7–30 wt-% of the lubricant;

1–5 wt-% linear quaternary ammonium antimicrobial agent;

chelating agent; and water;

wherein phosphate ester and the linear quaternary ammonium antimicrobial agent are present in a weight ratio of 1.5:1 to about 30:1.

17. The lubricant of claim 16, wherein the ratio of phosphate ester to the linear quaternary ammonium antimicrobial agent is effective to retain clarity of a mixture of the lubricant and a beverage.

18. The lubricant of claim 17, wherein the ratio is about 2.5:1 and the mixture retains clarity when the mixture comprises 50% lubricant and 50% beverage.

19. The lubricant of claim 17, wherein the ratio is 1.5:1 and the mixture retains clarity when the mixture comprises more than 50% lubricant and less than 50 beverage.

20. The lubricant of claim 17, wherein the ratio is about 16:1 and the mixture retains clarity when the mixture comprises less than 50% lubricant and more than 50% beverage.

21. The lubricant of claim 16, wherein the ratio is 1.5:1 to 10:1.

22. The lubricant of claim 16, wherein the ratio is 2:1 to 10:1.

23. The lubricant of claim 16, wherein the ratio is 2:1 to 8:1.

24. The lubricant of claim 16, wherein the pH of the lubricant is less than 8.5.

25. The lubricant of claim 16, wherein the lubricant is formulated to provide increased antimicrobial activity of the linear quaternary ammonium antimicrobial agent when the lubricant is mixed with a beverage having a pH lower than the lubricant.

26. The lubricant of claim 16, further comprising alkali metal hydroxide or ammonium salt.

27. The lubricant of claim 26, comprising sodium hydroxide.

28. The lubricant of claim 16, wherein the chelating agent comprises an aminoacetic acid chelating agent.

29. The lubricant of claim 16, further comprising alcohol ethoxylate comprising a $C_{12}$–$C_{15}$ linear alcohol with 7 ethylene oxide units.

30. The lubricant of claim 16, further comprising aryl alkoxylated phosphate ester.

31. The lubricant of claim 30, wherein the aryl alkoxylated phosphate ester comprises a phenol phosphate ester wherein the phenol group is not substituted with alkyl groups.

32. The lubricant of claim 30, comprising alkyl alkoxylated phosphate ester comprising an alkyl group of 10 to 12 carbon atoms and an alkoxy moiety of 5 ethylene oxide units, phenol ethoxylated phosphate ester, didecyl dimethyl ammonium chloride, EDTA, and water; and further comprising alkali metal hydroxide or ammonium salt and $C_{12\text{-}15}$ linear alcohol ethoxylated with 7 ethylene oxide units.

33. A process for lubricating a conveyor used to transport containers, the process comprising applying a phosphate ester antimicrobial lubricant composition to the conveying surface of a conveyor and moving containers on the conveyor;

the lubricant comprising:

alkyl alkoxylated phosphate ester, the total concentration of phosphate ester being 7–30 wt-% of the lubricant;

1–5 wt-% linear quaternary ammonium antimicrobial agent;

chelating agent; and water;

wherein:

the antimicrobial phosphate ester conveyor lubricant is free of fatty acid; and phosphate ester and the linear quaternary ammonium antimicrobial agent are present in a weight ratio of 1.5:1 to about 30:1.

34. The process of claim 33, wherein the ratio of phosphate ester to the linear quaternary ammonium antimicrobial agent is effective to retain clarity of a mixture of the lubricant and a beverage.

35. The process of claim 33, wherein the pH of the lubricant is less than 8.5.

36. The process of claim 33, wherein the lubricant is formulated to provide increased antimicrobial activity of the linear quaternary ammonium antimicrobial agent when the lubricant is mixed with a beverage having a pH lower than the lubricant.

37. The process of claim 33, wherein the lubricant composition further comprises sodium hydroxide.

38. The process of claim 33, wherein the chelating agent comprises an aminoacetic acid chelating agent.

39. The process of claim 33, wherein the lubricant composition further comprises alcohol ethoxylate comprising a $C_{12}$–$C_{15}$ linear alcohol with 7 ethylene oxide units.

40. The process of claim 33, wherein the lubricant composition further comprises aryl alkoxylated phosphate ester.

41. The process of claim 40, wherein the aryl alkoxylated phosphate ester comprises a phenol phosphate ester wherein the phenol group is not substituted with alkyl groups.

42. The process of claim 40, wherein the lubricant composition comprises alkyl alkoxylated phosphate ester comprising an alkyl group of 10 to 12 carbon atoms and an alkoxy moiety of 5 ethylene oxide units, phenol ethoxylated phosphate ester, didecyl dimethyl ammonium chloride, EDTA, and water; and further comprising alkali metal hydroxide or ammonium salt and $C_{12\text{-}15}$ linear alcohol ethoxylated with 7 ethylene oxide units.

43. A process for lubricating a conveyor used to transport containers, the process comprising applying a phosphate ester antimicrobial lubricant composition to the conveying surface of a conveyor and moving containers on the conveyor;

the lubricant comprising:

alkyl alkoxylated phosphate ester, and aryl alkoxylated phosphate ester, the total concentration of phosphate ester being 7–30 wt-% of the lubricant;

1–5 wt-% quaternary ammonium antimicrobial agent;

chelating agent; and water;

wherein:

the antimicrobial phosphate ester conveyor lubricant is free of fatty acid; and phosphate ester and the quaternary ammonium antimicrobial agent are present in a weight ratio of 1.5:1 to about 30:1.

44. The process of claim 43, wherein the quaternary ammonium antimicrobial agent comprises a linear quaternary ammonium antimicrobial agent.

45. The process of claim 43, wherein the ratio of phosphate ester to the quaternary ammonium antimicrobial agent is effective to retain clarity of a mixture of the lubricant and a beverage.

46. The process of claim 43, wherein the pH of the lubricant is less than 8.5.

47. The process of claim 43, wherein the lubricant is formulated to provide increased antimicrobial activity of the quaternary ammonium antimicrobial agent when the lubricant is mixed with a beverage having a pH lower than the lubricant.

48. A process for lubricating a conveyor used to transport containers, the process comprising applying a phosphate ester antimicrobial lubricant composition to the conveying surface of a conveyor and moving containers on the conveyor;

the lubricant comprising:

alkyl alkoxylated phosphate ester, the total concentration of phosphate ester being 7–30 wt-% of the lubricant;

1–5 wt-% linear quaternary ammonium antimicrobial agent;

chelating agent; and water;

wherein phosphate ester and the quaternary ammonium antimicrobial agent are present in a weight ratio of 1.5:1 to about 30:1.

49. The process of claim 48, wherein the ratio of phosphate ester to the linear quaternary ammonium antimicrobial agent is effective to retain clarity of a mixture of the lubricant and a beverage.

50. The process of claim 49, wherein the ratio is about 2.5:1 and the mixture retains clarity when the mixture comprises 50% lubricant and 50% beverage.

51. The process of claim 49, wherein the ratio is 1.5:1 and the mixture retain clarity when the mixture comprises more than 50% lubricant and less than 50% beverage.

52. The process of claim 49, wherein the ratio is about 16:1 and the mixture retains clarity when the mixture comprises less than 50% lubricant and more than 50% beverage.

53. The process of claim 48, wherein the ratio is 1.5:1 to 10:1.

54. The process of claim 48, wherein the ratio is 2:1 to 10:1.

55. The process of claim 48, wherein the ratio is 2:1 to 8:1.

56. The process of claim 48, wherein the pH of the lubricant is less an 8.5.

57. The process of claim 48, wherein the lubricant is formulated to provide increased antimicrobial activity of the linear quaternary ammonium antimicrobial agent when the lubricant is mixed with a beverage having a pH lower than the lubricant.

58. The process of claim 48, wherein the lubricant composition further comprises alkali metal hydroxide or ammonium salt.

59. The process of claim 58, where the lubricant composition comprises sodium hydroxide.

60. The process of claim 48, wherein the chelating agent comprises an aminoacetic acid chelating agent.

61. The process of claim 48, wherein the lubricant composition further comprises alcohol ethoxylate comprising a $C_{12}$–$C_{15}$ linear alcohol with 7 ethylene oxide units.

62. The process of claim 48, wherein the lubricant composition further comprises aryl alkoxylated phosphate ester.

63. The process of claim 62, wherein the aryl alkoxylated phosphate ester comprises a phenol phosphate ester wherein the phenol group is not substituted with alkyl groups.

64. The process of claim 62, wherein the lubricant composition comprises alkyl alkoxylated phosphate ester comprising an alkyl group of 10 to 12 carbon atoms and an alkoxy moiety of 5 ethylene oxide units, phenol ethoxylated phosphate ester, didecyl dimethyl ammonium chloride, EDTA, and water, and further comprising alkylating agent, and $C_{12-15}$ linear alcohol ethoxylated with 7 ethylene oxide units.

65. An antimicrobial phosphate ester conveyor lubricant comprising:

alkyl alkoxylated phosphate ester;

linear quaternary ammonium antimicrobial agent;

alkali metal hydroxide or ammonium salt; and water;

wherein the antimicrobial phosphate ester conveyor lubricant is free of fatty acid.

66. An antimicrobial phosphate ester conveyor lubricant comprising:

alkyl alkoxylated phosphate ester;

linear quaternary ammonium antimicrobial agent;

a phenol phosphate ester wherein the phenol alkoxylated group is not substituted with alkyl groups; and water;

wherein the antimicrobial phosphate ester conveyor lubricant is free of fatty acid.

67. An antimicrobial phosphate ester conveyor lubricant comprising:

alkyl alkoxylated phosphate ester;

aryl alkoxylated phosphate ester;

quaternary ammonium antimicrobial agent;

alkali metal hydroxide or ammonium salt; and water;

wherein the antimicrobial phosphate ester conveyor lubricant is free of fatty acid.

68. An antimicrobial phosphate ester conveyor lubricant comprising:

alkyl alkoxylated phosphate ester;

a phenol phosphate ester wherein the phenol group is not substituted with alkyl groups;

quaternary ammonium antimicrobial agent; and water;

wherein the antimicrobial phosphate ester conveyor lubricant is free of fatty acid.

69. An antimicrobial phosphate ester conveyor lubricant comprising:

alkyl alkoxylated phosphate ester;

linear quaternary ammonium antimicrobial agent;

alkali metal hydroxide or ammonium salt; and water;

wherein phosphate ester and the linear quaternary ammonium antimicrobial agent are present in a weight ratio of 1.5:1 to about 30:1.

70. An antimicrobial phosphate ester conveyor lubricant comprising:

alkyl alkoxylated phosphate ester;

linear quaternary ammonium antimicrobial agent;

a phenol phosphate ester wherein the phenol alkoxylated group is not substituted with alkyl groups; and water;

wherein phosphate ester and the linear quaternary ammonium antimicrobial agent are present in a weight ratio of 1.5:1 to about 30:1.

71. A process for lubricating a conveyor used to transport containers, the process comprising applying a phosphate ester antimicrobial lubricant composition to the conveying surface of a conveyor and moving containers on the conveyor;

the lubricant comprising:

alkyl alkoxylated phosphate ester;

linear quaternary ammonium antimicrobial agent;

alkali metal hydroxide or ammonium salt; and water;

wherein the antimicrobial phosphate ester conveyor lubricant is free of fatty acid.

72. A process for lubricating a conveyor used to transport containers, the process comprising applying a phosphate ester antimicrobial lubricant composition to the conveying surface of a conveyor and moving containers on the conveyor;

the lubricant comprising:

alkyl alkoxylated phosphate ester;

linear quaternary ammonium antimicrobial agent;

a phenol phosphate ester wherein the phenol alkoxylated group is not substituted with alkyl groups; and water;

wherein the antimicrobial phosphate ester conveyor lubricant is free of fatty acid.

73. A process for lubricating a conveyor used to transport containers, the process comprising applying a phosphate ester antimicrobial lubricant composition to the conveying surface of a conveyor and moving containers on the conveyor;

the lubricant comprising:

alkyl alkoxylated phosphate ester;

aryl alkoxylated phosphate ester;

quaternary ammonium antimicrobial agent;

alkali metal hydroxide or ammonium salt; and water;

wherein the antimicrobial phosphate ester conveyor lubricant is free of fatty acid.

74. A process for lubricating a conveyor used to transport containers, the process comprising applying a phosphate ester antimicrobial lubricant composition to the conveying surface of a conveyor and moving containers on the conveyor;

the lubricant comprising:

alkyl alkoxylated phosphate ester;

a phenol alkoxylated phosphate ester wherein the phenol alkoxylated group is not substituted with alkyl group;

quaternary ammonium antimicrobial agent; and water;

wherein the antimicrobial phosphate ester conveyor lubricant is free of fatty acid.

75. A process for lubricating a conveyor used to transport containers, the process comprising applying a phosphate ester antimicrobial lubricant composition to the conveying surface of a conveyor and moving containers on the conveyor;

the lubricant comprising:

alkyl alkoxylated phosphate ester;

linear quaternary ammonium antimicrobial agent;

alkali metal hydroxide or ammonium salt; and water;

wherein phosphate ester and the quaternary ammonium antimicrobial agent are present in a weight ratio of 1.5:1 to about 30:1.

76. A process for lubricating a conveyor used to transport containers, the process comprising applying a phosphate ester antimicrobial lubricant composition to the conveying surface of a conveyor and moving containers on the conveyor;

the lubricant comprising:

alkyl alkoxylated phosphate ester;

linear quaternary ammonium antimicrobial agent;

a phenol alkoxylated phosphate ester wherein the phenol alkoxylated group is not substituted with alkyl groups; and water;

wherein phosphate ester and the quaternary ammonium antimicrobial agent are present in a weight ratio of 1.5:1 to about 30:1.

* * * * *

UNITED STATES PATENT AND TRADEMARK OFFICE

CERTIFICATE OF CORRECTION

PATENT NO. : 6,756,347 B1
DATED : June 29, 2004
INVENTOR(S) : Besse et al.

It is certified that error appears in the above-identified patent and that said Letters Patent is hereby corrected as shown below:

Title page,
Item [63], Related U.S. Application Data, "Continuation-in-part of application No. 09/002,976, filed on Jan. 8, 1999, now abandoned." should read -- Continuation-in-part of application No. 09/002,976, filed on Jan. 5, 1998, now abandoned. --

Column 1,
Line 7, "Ser. No. 09/002,976 filed Jan. 8, 1999," should read -- Ser. No. 09/002,976 filed Jan. 5, 1998, --

Column 9,
Line 54, "the liner quaternary" should read -- the linear quaternary --

Column 10,
Line 27, "of claim 1," should read -- of claim 1, --
Line 62, "is less 8.5." should read -- is less than 8.5. --

Column 11,
Line 22, "than 50 beverage." should read -- than 50% beverage --.

Column 13,
Line 32, "mixture retain clarity" should read -- mixture retains clarity --
Line 45, "is less an 8.5." should read -- is less than 8.5. --

Signed and Sealed this

Sixteenth Day of November, 2004

JON W. DUDAS
*Director of the United States Patent and Trademark Office*